United States Patent [19]

Gin

[11] 4,451,034

[45] May 29, 1984

[54] DEVICE FOR YOGA EXERCISING

[76] Inventor: Abram Gin, 99-40 63rd, Forest Hills, N.Y. 11375

[21] Appl. No.: 331,030

[22] Filed: Dec. 15, 1981

Related U.S. Application Data

[62] Division of Ser. No. 851,624, Nov. 15, 1977, Pat. No. 4,307,880.

[51] Int. Cl.[3] ..... A63B 23/00

[52] U.S. Cl. ..... 272/93; 272/DIG. 4; 272/144

[58] Field of Search ..... 272/93, 70.1, 109, 112, 272/134, 144, 145, 146, 127, 113, DIG. 4, 143, 56, 135, 138, 142; 135/104, 105; 52/86; 128/70

[56] References Cited

U.S. PATENT DOCUMENTS

| | | | |
|---|---|---|---|
| 16,767 | 3/1857 | Worthen | 52/86 |
| 1,669,063 | 5/1928 | Mills | 272/70.1 |
| 2,010,766 | 9/1935 | Longfellow | 128/70 |
| 2,533,273 | 12/1950 | MacGregor | 272/144 |
| 2,723,856 | 11/1955 | Thomson | 272/135 |
| 4,210,322 | 7/1980 | Pritchard | 272/144 |

FOREIGN PATENT DOCUMENTS

| | | | |
|---|---|---|---|
| 1151095 | 7/1963 | Fed. Rep. of Germany | 128/70 |
| 2160642 | 6/1973 | Fed. Rep. of Germany | 272/145 |
| 1281383 | 12/1961 | France | 272/56 |

*Primary Examiner*—Richard J. Apley
*Assistant Examiner*—S. R. Crow
*Attorney, Agent, or Firm*—Ilya Zborovsky

[57] ABSTRACT

A device for exercising Yoga has an elongated resiliently deformable element movable to a position in which it is convex so that the practitioner resting on said element from outside assumes a candle-like posture and a connecting element retaining the resiliently deformable element in the above position. A method of forming the device includes the steps of respectively deforming and retaining the resiliently deformable element so that the practitioner's body can assume the candle-like position.

12 Claims, 6 Drawing Figures

DEVICE FOR YOGA EXERCISING

This application is a division of application Ser. No. 851,624, filed Nov. 15, 1977, now U.S. Pat. No. 4,307,880.

BACKGROUND OF THE INVENTION

The present invention relates to a device for exercising Yoga. More particularly, it relates to exercising in a candle-like posture.

It is well known that a Yoga practitioner must assume respective postures for performing respective Yoga exercises. However, up to now Yoga practitioners have assumed respective postures by themselves without the aid of specific devices. This possesses essential disadvantages which will be described hereinbelow. The Yoga exercises assure medical and restoring action only in the case when they are correctly performed. Since the Yoga exercises are substantially complicated to be performed, a person which is going to start exercising encounters many difficulties. Such person may have no time for lengthy studying, he or she may not be sufficiently persistent, he or she may have no trainer for providing competent help, he or she must spend essential time in order to arrive at correct postures, he or she may have some interruptions in studying which make the process even more complicated and return the practitioner back to initial condition, he or she may be unwell after incorrectly mastered posture, and he or she may have excessive weight or may be sick. In all these cases it is very difficult to exercise Yoga.

SUMMARY OF THE INVENTION

Accordingly, it is an object of the present invention to provide a device for Yoga exercising which make Yoga exercises more accessible for practitioners, as compard with the known methods.

More particularly, it is an object of the present invention to provide a device for Yoga exercising so that Yoga exercises may be correctly executed substantially independently from practitioner's age, weight, inclination and ability for exercising, persistance, interruptions in mastering the exercises, and without a trainer.

Another object of the present invention is to provide a device for Yoga exercising which has a simple construction and is easy and inexpensive to manufacture.

In keeping with these objects, and with others which will become apparent hereinafter, one feature of the present invention resides in a device for Yoga exercising which has a resiliently deformable element movable to a position in which it is convex so that the practitioner resting on said element from outside assumes a candle-like posture; and means for retaining this element in the convex position.

Another feature of the present invention is a method of forming the device comprising the steps of deforming a resiliently deformable element to assume a convex contour so that when the practitioner's body rests on the element from outside it assumes a candle-like posture and retaining the element in this convex position.

When the practicioner executes Yoga exercises with the aid of the above device and method he or she does not need to be preliminarily trained and can immediately execute the Yoga exercices. This possibility does not depend on practicioner's weight, age, inclination and ability for exercising, persistance, interruptions in exercising and the like. The practitioner does not need to be taught by a trainer. During short time he or she will be convinced in fact that the device is simple and helpful, and he or she is able to improve his or her health by Yoga exercising.

Still another feature of the present invention is that the retaining means may include an elongated connecting element bracing the resiliently deformable element in the convex position. The connecting element may be adjustable in the direction of elongation thereof so as to vary its length in order to connect respective portions of the resiliently deformable element and to vary curvature of the later. Such adjustable connecting element may include two sections telescopically movable relative to one another and fixable in a plurality of positions. The connecting element has a rigidity exceeding the rigidity of the resiliently deformable element.

A further feature of the present invention is that the connecting element may rigidly connect end portions of the resiliently deformable element with one another. The connecting element also may rigidly connect one of the end portions of the resiliently deformable element with a section located intermediate another end portion and a central plane of the resiliently deformable element. In the later case, the connecting element may be connected with the above section in a plurality of positions spaced from one another so that curvature of the resiliently deformable element can be varied. Both the above connections may be used simultaneously and together.

A still further feature of the present invention is that the resiliently deformable element may have two or more separate members connectable with one another so as to form together the resiliently deformable element. When the members are disconnected from one another the device will be more compact and convenient for transportation.

An additional feature of the present invention is that the resiliently deformable element may have a rectilinear contour in an initial position. It is also possible that the resiliently deformable element has a curved contour in the initial position, which contour has a radius of curvature exceeding the radius of curvature of the same in the first, second and third positions. In the third position, the resiliently deformable element has a tendency to assume its initial curvature and thereby urges the practicioner's body to bend forward.

A still additional feature of the present invention is that a base member may be detachably connected to the resiliently deformable element so that the practitioner may place his or her body on the base member before executing the exercises and the deformable element connected thereto cannot move away from the practitioner. The base member may have at least one face surface provided with engaging formations so as to prevent slipping of the resiliently deformable element relative to a floor or the like and of the practitioner's body relative to the base member. It is to be understood that both face surfaces of the base member may be provided with such engaging formations.

Other objects, features and advantages of the of the present invention will become apparent from the subsequent description, taken in conjunction with the accompanying drawings.

DESCRIPTION OF PREFERRED EMBODIMENTS

Yoga exercising device in accordance with the present invention has a resiliently deformable element I which may be constituted of any material having the above characteristic.

Figure 1A:
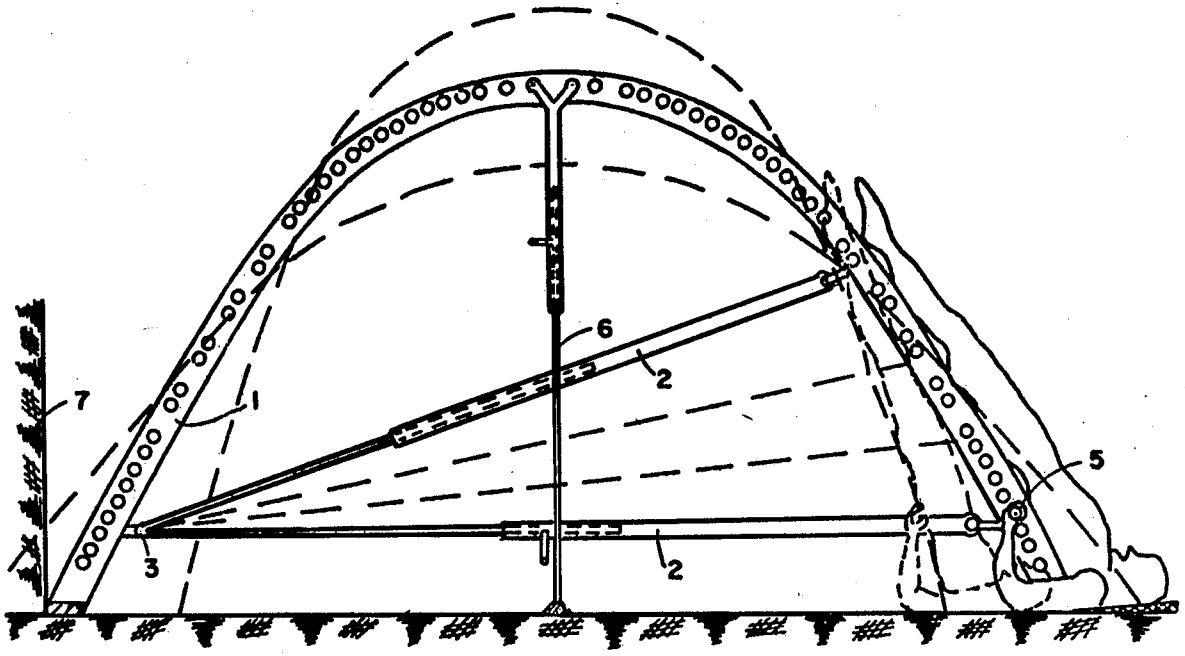
FIGS. 1*a* and 1*b* are front and side views showing a Yoga exercising device in a convex position.
Figure 1B:
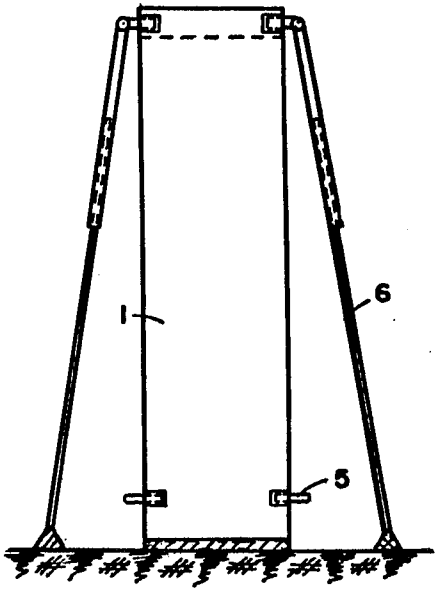

The deformable element I can be bent so as to assume a convex contour, as shown in FIG. 1 of the drawing. A connecting element 2 retains the deformable element I in this position. The connecting element 2 is detachably connected to the deformable element I so that one end portion of the former is connected to one end portion of the latter, whereas another end portion of the connecting element 2 may be connected to the deformable element I in one of a plurality of locations spaced from one another, as indicated in solid and broken lines in FIG. 1. Thus, the deformable member I can have different radii of curvature, and different resiliency of the latter. The connecting element 2 is connected to the deformable element I by conventional means, such as pivot means 3 shown in FIG. 1.

The deformable element I has a plurality of bores 4 spaced from one another in the direction of elongation thereof, in each of which bores 4 handles 5 shown in FIG. 9 may be detachably inserted. By means of the handles 5 the practitioner can vary stress applied thereto during the Yoga exercise.

It is also possible to provide in the device at least two such connecting elements. In this case, one of the connecting elements may connect the end portions of the resiliently deformable element I, whereas another connecting element may connect one of the end portions of the resiliently deformable element I with a section thereof located between the other end portion and the central plane of the resiliently deformable element I. The practitioner places his body outside the convex deformable element I so that he or she can assume a candle-like posture or Sarvangasana. The above handles 5 may be inserted in the bores 4 located adjacent to end portion of the deformable element I so that the practitioner can grasp the handles and assume as well as reliably retain himself or herself in this position. The end portions of the deformable element I may have leg sections. Spreaders 6 may be provided so as to support the device in stable condition. The device may abut against a wall 7 of the living unit.

Figure 4:
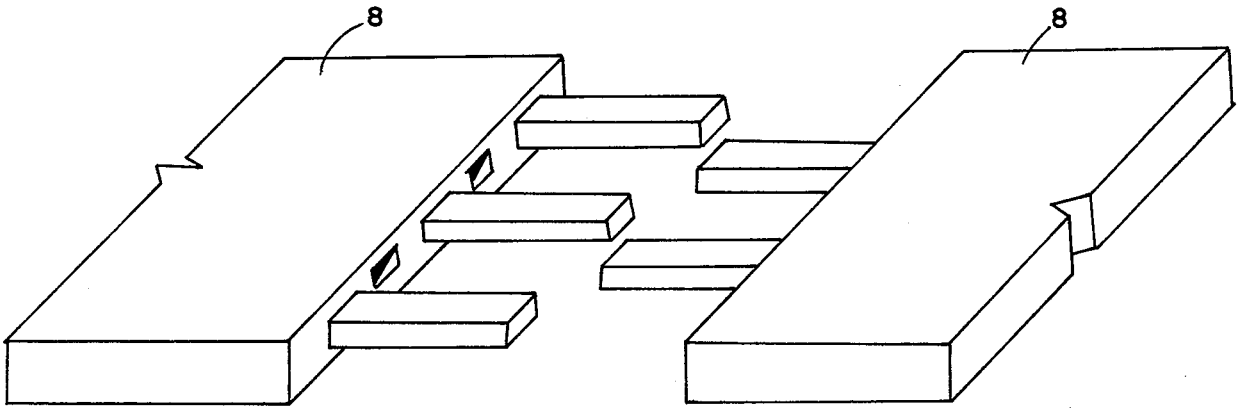
FIG. 4 is a view showing a resiliently deformable element of the Yoga exercising device including two sections detachably connectable with one another.

The deformable element I may have two separate sections 8' and 8'' detachably connectable with one another, as shown in FIG. 4. Thus-formed element can be easily dismounted. The device becomes compact and occupies a comparatively small space, for instance, for transportation.

A base member 9 may be detachably connected to the end portion of the deformable element I. The practitioner may sit or lie down on the base member 9 and thereupon start exercising. The base member cannot move away owing to the practitioner's weight applied thereto, and therefore the deformable element 1 is precented from moving away from the practitioner. One or both face surfaces of the base member 9 may be provided with engaging formations so as to prevent slipping of the base member 9 relative to a floor and the like and/or slipping of the practitioner's body relative to the base member.

Figure 2:
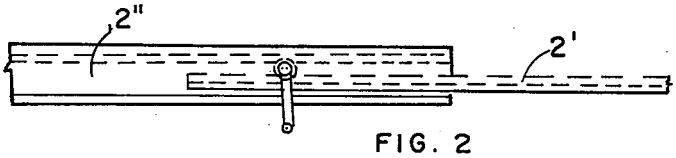
FIG. 2 is a view showing a connecting element including two sections movable relative to and connectable with one another.
Figure 5:
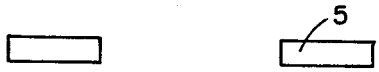
FIG. 5 is a view showing handles detachably connectable with the resiliently deformable element of the Yoga exercising device.
Figure 3:
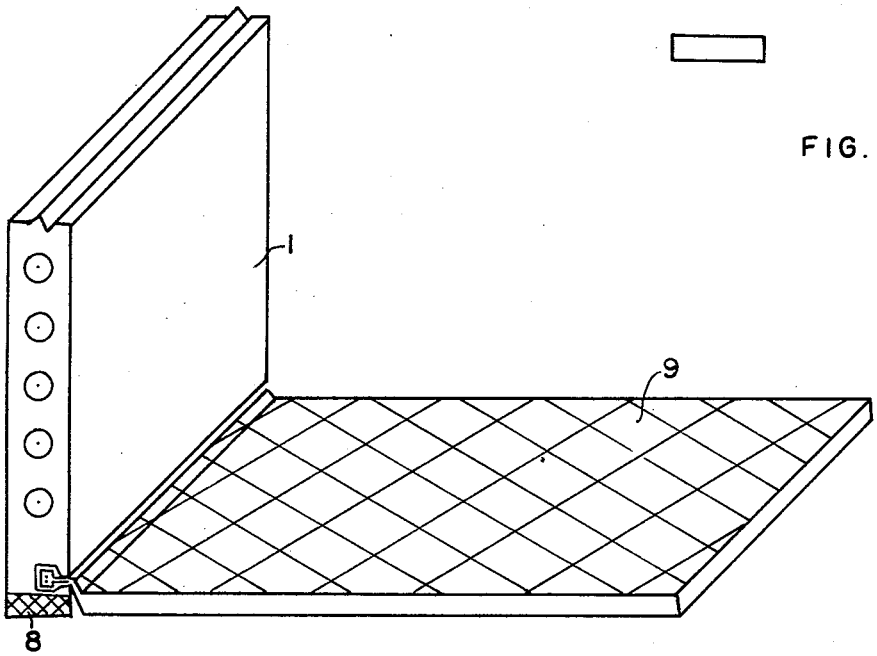
FIG. 3 is a view showing a base member detachably connected to a resiliently deformable element of the Yoga exercising device.

The connecting element 2 may be adjustable in the direction of elongation thereof. For instance, the connecting element may be composed of two or more separate sections, such as 2' and 2'', as shown in FIG. 2, which telescopically move relative to one another and are fixed in a plurality of mutual positions so that the length of the connecting element 2 may be varied. By varying the length of the connecting element 2 the curvature of the resiliently deformable element I can be varied, so that the practitioner can vary the curvature and angle of inclination of his or her body in the candle-like posture. In the latter case, the practitioner can gradually master a plurality of postures, starting from a posture with a small angle of inclination, and thereupon can gradually increase this angle. The connecting element 2 must have rigidity exceeding the rigidity of the deformable element I so as to brace the latter in a respective position.

The deformable element I in an initial or inoperative position may have a substantially rectilinear contour which subsequently will be changed by bending of the deformable element I into a respective position. It is to be understood that the practitioner can bend the deformable element I by himself or herself. On the other hand, the deformable element I may have in the initial condition a concave contour. In the latter case the deformable element I must be bent by the practitioner into a more curved contour as compared with that in the initial position. A radius of curvature of the deformable element I in the third position will be smaller than that in the initial position, and therefore the practitioner will be urged by the element I to bend forward.

The deformable element I may be adjustable in the direction of elongation thereof so as to vary its length. This can be done by means which are similar to the means shown in FIG. 2 for adjusting the length of the connecting element 2, or by other conventional means.

While it will be apparent that the preferred embodiments of the invention herein disclosed are well calculated to fulfill the objects above stated, it will be appreciated that the invention is susceptible to modifications, variations and changes without departing from the proper scope or fair meaning of the subjoined claims. The device may also be used for executing other Yoga exercises which differ from those described above.

What is intended to be claimed and protected by Letters Patent is:

1. A Yoga exercising device, comprising an elongated resiliently deformable element movable to a position in which it is convex and fixedly retained in said position so that a practitioner resting on said element from outside assumes a candle-like posture, said resiliently deformable element having two ends spaced from one another in the direction of elongation thereof, a central plane spaced an equal distance from said ends, and two portions each located between said central plane and a respective one of said ends; means for retaining said resiliently deformable element in said convex position and including an elongated connecting element detachably bracing said resiliently deformable element from inside in said position, said connecting element having two end sections spaced from one another in the direction of elongation thereof, one of said sections of said connecting element being connected to said resiliently deformable element in the region of one of said ends of the latter, and the other section of said connecting element being connected to said resiliently deformable element in the region located between said central plane and the other end of the latter; and means for connecting said other section of said connecting element to said resiliently deformable element in a plurality of locations between said central plane and the other end of said resiliently deformable element.

2. The device as defined in claim 1 wherein said connecting element is adjustable in the direction of elongation thereof so as to vary its length; and further comprising means for adjusting and fixing the length of said connecting element.

3. The device as defined in claim 2, wherein said connecting element includes at least two separate sections telescopically movable relative to one another in the direction of elongation of said connecting element between a plurality of positions spaced from one another in said direction of elongation, said adjusting and fixing means including members arranged for fixing said sections relative to one another in said position.

4. The device as defined in claim 1, wherein said connecting element has a rigidity exceeding the rigidity of said resiliently deformable element.

5. The device as defined in claim 1, wherein said resiliently deformable element has an initial position from which it is moved into said convex position, said resiliently deformable element having in said initial position a substantially rectilinear contour.

6. The device as defined in claim 1, wherein said resiliently deformable element has an initial position from which it is moved into said convex position and in which it is substantially curved and has a first radius of curvature, said resiliently deformable element having in said convex position in second radius of curvature which is smaller than said first radius of curvature.

7. The device as defined in claim 1; and further comprising means for preventing movement of said resiliently deformable element away from the practitioner, said preventing means including a plate-like base member detachably connectable to said resiliently deformable element and arranged to rest on a floor so that when the practitioner placed his or her body on said base member the said base member cannot move relative to the floor and thereby said resiliently deformable element connected with said base member cannot move away from the practitioner.

8. The device as defined in claim 7, wherein said base member has two face surfaces facing towards the floor and toward the practitioner's body, respectively, said face surfaces having engaging formations adapted to reduce slipping of said base member relative to the floor and slipping of the practitioner's body relative to said base member, respectively.

9. The device as defined in claim 1; and further comprising at least one pair of handles detachably connectable with said resiliently deformable element in a plurality of locations spaced from one another in the direction of elongation of the said resiliently deformable element and adapted to be held by the practitioner's hands in said position.

10. The device as defined in claim 20, wherein said resiliently deformable element is adjustable in the direction of elongation thereof so as to vary its length; and further comprising means for adjusting and fixing the length of said resiliently deformable element.

11. The device as defined in claim 1; and further comprising at least one additional connecting element detachably connecting said ends of said resiliently deformable element.

12. The device as defined in claim 1, wherein said resiliently deformable element is further deformable in said convex position, so as to assume contours having differing radii of curvature.

* * * * *